US006347957B1

(12) United States Patent
Hwqng

(10) Patent No.: US 6,347,957 B1
(45) Date of Patent: Feb. 19, 2002

(54) ELECTRICAL CONNECTOR ASSEMBLY WITH A COMPACT LATCHING DEVICE

(75) Inventor: Jenq-Yih Hwqng, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/672,135

(22) Filed: Sep. 27, 2000

Related U.S. Application Data

(63) Continuation-in-part of application No. 09/351,411, filed on Jul. 9, 1999, now Pat. No. 6,132,241.

(51) Int. Cl.[7] ..... H01R 13/58
(52) U.S. Cl. ..... 439/459; 439/405
(58) Field of Search ..... 439/459, 456, 439/492, 499, 405, 404

(56) References Cited

U.S. PATENT DOCUMENTS 4,648,677 A * 3/1987 Lang ..... 439/459
4,925,401 A * 5/1990 Fogg et al. ..... 439/465
4,960,390 A * 10/1990 Davis et al. ..... 439/459
5,125,850 A * 6/1992 Locati ..... 439/404
5,338,221 A * 8/1994 Bowen et al. ..... 439/405

* cited by examiner

*Primary Examiner*—Gary F. Paumen
(74) *Attorney, Agent, or Firm*—Wei Te Chung

(57) ABSTRACT

An electrical connector assembly (1) includes a first connector 10 assembled to a printed circuit board and a second connector (20) releasably mated thereto. The second connector includes a second housing (21) defining a cavity for receiving an island portion (12) of the first connector. The second housing forms a pair of mounting wedges (22) at opposite ends thereof and retaining recesses (23) adjacent to the mounting wedges. A termination cover (24) assembled to the second connector includes a pair of mounting lugs (24*a*) engaged to the mounting wedges. A pair of passages (24*b*) defined in the cover is adjacent to the mounting lugs. A strain relief (30) assembled to the termination cover forms inner latches (32) engaged to the retaining recesses and outer latches (33) pivotally hinged to a base bar (31). Each outer latch forms a slim beam (33*a*) which interlocks with the latching wedges of the first connector and a pair of shoulders (33*c*) extending perpendicularly from the beam for latchably engaging the latching wedges of the first connector. The slim beam is substantially flush with the latching wedges, thereby assuring the entire electrically assembly has a compact size.

1 Claim, 4 Drawing Sheets

ELECTRICAL CONNECTOR ASSEMBLY WITH A COMPACT LATCHING DEVICE

CROSS-REFERENCE TO RELATED APPLICATION

This application is a Continuation-In-Part (CIP) of the U.S. patent application Ser. No. 09/351411, filed on Jul. 9, 1999 U.S. Pat. No. 6,132,241.

BACKGROUND OF THE INVENTION

1. Field of the Invention

The present invention relates to an electrical connector assembly, and more particularly to an assembly having a first connector and a second connector mated to the first connector. Interconnection between the first and second connector is facilitated by latching means such that the overall length is shortened.

2. Description of the Prior Art

Conventionally, an IDC connector assembled to an end of a cable is directly plugged to a complimentary connector (normally a header connector) mounted on a printed circuit board. The termination between insulation displacement portions and conductors of the cable is facilitated by a termination cover assembled to the housing of the IDC connector. One approach preventing the termination from being accidentally separated during withdraw of the IDC connector from the header is to provide a strain relief assembled to the termination cover, thereby preventing the termination from being damaged during removal of the IDC connector.

Another approach addressing this problem is to provide a pull-tab assembled to the termination cover. This may also prevent the termination from being separated during removal of the IDC connector.

Ultra SCSI connectors made in the form of IDC connector have encountered problems during mating/unmating between two ultra SCSI connectors because the normal force existing between two mated connectors is too large to overcome using fingers alone. A strain relief is often used to aid easy removal of a female ultra SCSI connector, which is usually assembled to an end of a cable, from a header SCSI connector, which is usually mounted on a printed circuit board. U.S. Pat. Nos. 4,925,401 and 5,125,850 disclose the related connectors.

In the parent application Ser. No. 09/351,411, the female connector, which is mounted on the printed circuit board, has a pair of hooks for locking with the outer latches of the strain relief. Anyhow, some different type female connectors may have differently positioned, i.e., relatively outer, hooks, and thus the corresponding outer latches of the strain relief should be reconfigured so as to not only compliantly latchably engage the corresponding hooks but also keep the minimum lengthwise dimension of the whole assembly.

Hence, an improved electrical connector assembly is required to overcome the disadvantages of the prior art.

BRIEF SUMMARY OF THE INVENTION

A main object of the present invention is to provide an electrical connector assembly having a first connector and a second connector mated to the first connector. Interconnection between the first and second connectors is ensured by a strain relief having outer latches which can effectively bind the electrical assembly together in a compact size.

Another object of the present invention is to provide an electrical connector assembly having a first connector end a second connector mated to the first connector. Interconnection between the first and second connectors is ensured by a strain relief having inner latches which are well protected from being accidentally released during mating of the first and second connector;

An electrical connector assembly comprises a first connector adapted to be mounted onto a printed circuit board and a second connector releasably mated thereto. The first connector forms a pair of latching wedges on either end thereof. The second connector mated to the first connector includes a second housing defining a cavity for receiving an island portion of the first connector. The second housing forms a pair of mounting wedges at opposite ends thereof and retaining recesses adjacent to the mounting wedges. A termination cover assembled to the second connector includes a pair of mounting lugs engaged to the mounting wedges. A pair of passages is defined in the cover adjacent to the mounting lugs. A strain relief assembled to the termination cover forms inner latches engaging with the retaining recess, and outer latches pivotally hinged a base bar of the strain relief. Each outer latch forms a slim beam releasably sandwiched between the latching wedges on either end of the first connector and has a thickness substantially identical to that of the latching wedge, thereby assuring the connector assembly has a compact size.

Other objects, advantages and novel features of the invention will become more apparent from the following detailed description of the present embodiment when taken in conjunction with the accompanying drawings.

DETAILED DESCRIPTION OF THE INVENTION

Figure 1:
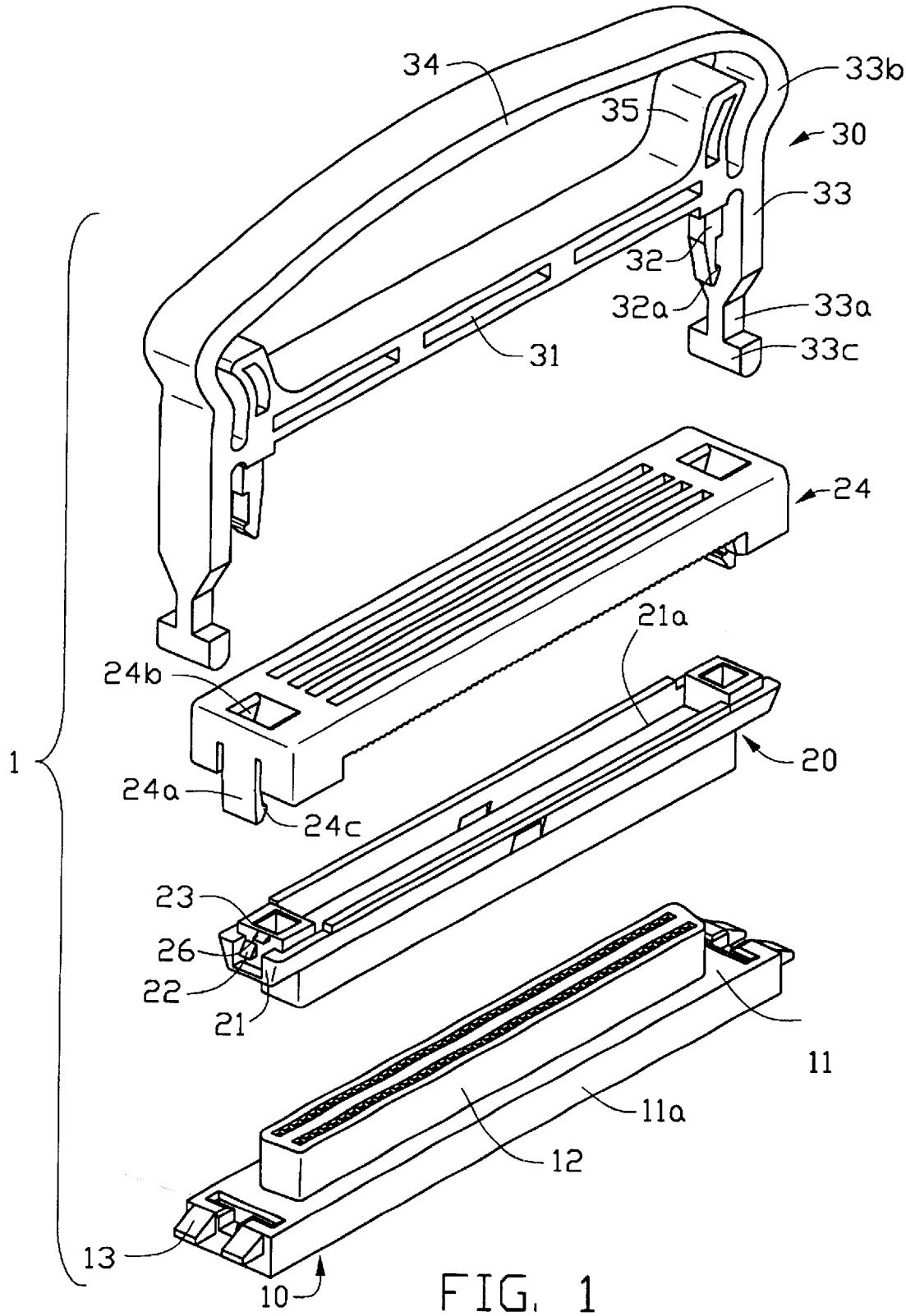
FIG. 1 is an exploded perspective view of an electrical connector assembly in accordance with the present invention.
Figure 2:
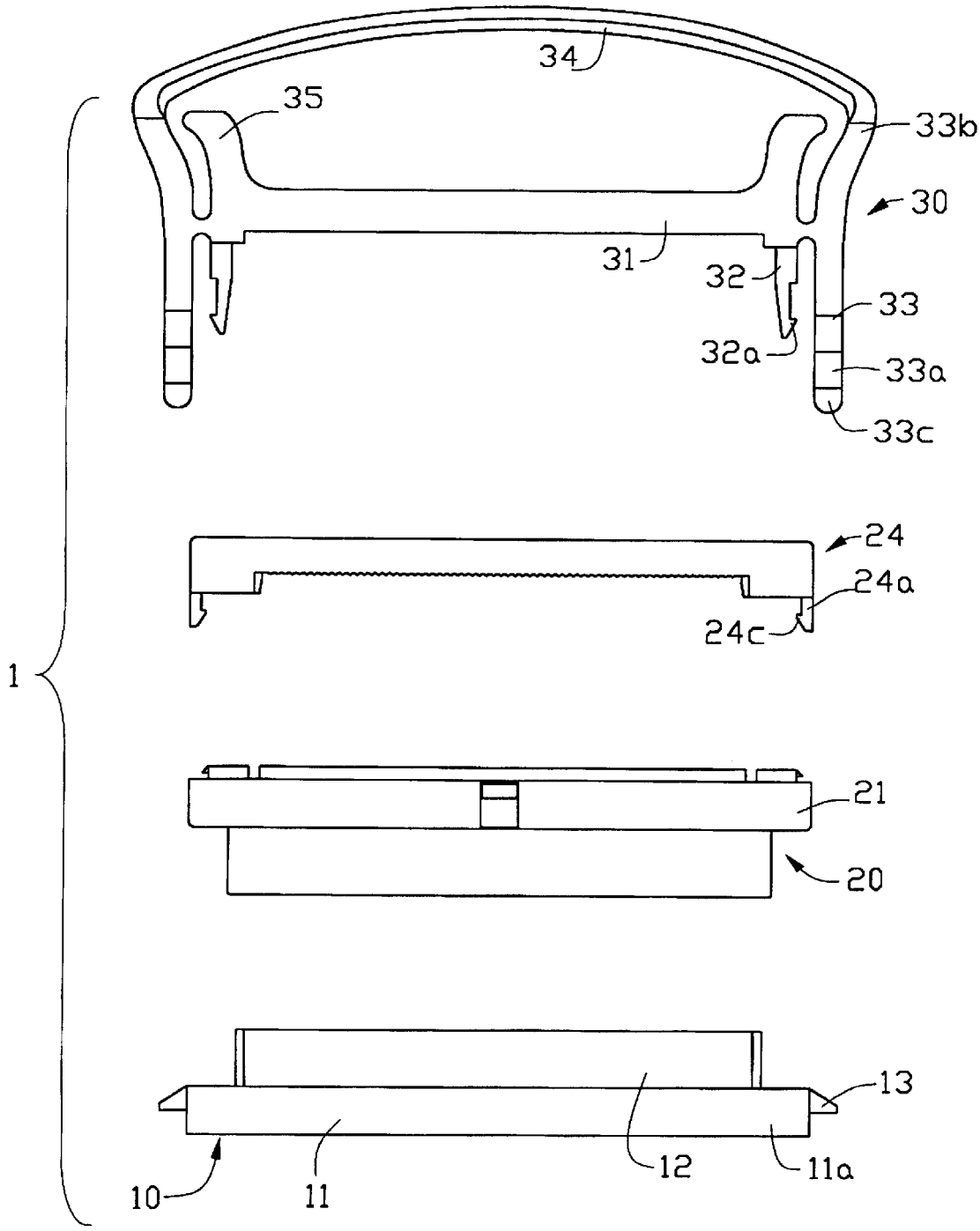
FIG. 2 is a front planar view of FIG. 1.

Referring to FIGS. 1 and 2, an electrical connector assembly 1 in accordance with the present invention comprises a first connector 10 and a second connector 20 mated with the first connector 10. In the preferred embodiment, the first connector 10 is a female ultra SCSI connector and the second connector 20 is an IDC SCSI connector. The first connector 10 can be assembled to a printed circuit board (not shown).

The first connector 10 includes a first housing 11 having a base plate 11*a* and an island portion 12 on the base plate 11*a*. A pair of latching wedges 13 extend outward from either end of the base plate 11*a* and are spaced apart from each other with a predetermined distance.

The second connector 20 includes a second housing 21 defining a cavity (not labeled) for receiving the island portion 12 of the first connector 10. The second housing 21 has a termination face 21*a* opposite to the cavity. A support wedge 26 and a mounting wedges 22 below the support wedge 26 are formed on either lateral end of the second housing 21. The second housing 21 further defines a pair of retaining recesses 23 adjacent to the support wedges 26. An engaging block 23*a* is formed within the retaining recess 23 (FIG. 4).

A termination cover 24 is assembled to the termination face 21*a* of the second connector 20 for performing electrical connections between a flat flexible cable (FFC) connector and insulation displacement sections (not shown) of the second connector 20. The termination cover 24 includes a pair of mounting lugs 24*a* each having thereon an inward projection 24*c* engageable to the mounting wedge 22 of the second connector 20. A pair of passages 24*b* is defined in the cover 24 adjacent to the mounting lugs 24*a*.

A strain relief 30 is assembled to the first and second connectors 10, 20. The strain relief 30 includes a base bar 31 forming a pair of inner latches 32 and a pair of outer latches 33 pivotally hinged to said base bar 31 at opposite ends thereof. The inner latches 32 extend through the passages 24*b* of the termination cover 24 and into the retaining recesses 23 of the second connector 20. The inner latch 32 defines an outward projection 32*a* for engaging with the engaging block 23*a* when the strain relief 30 is assembled to the second connector 20. Because the inner latches 32 are inserted within the retaining recesses 23, engagements between the projections 32*a* and the engaging blocks 23*a* can be reliably ensured. Each outer latch 33 forms a slim beam 33*a*, and a pair of shoulders 33*c* extending perpendicularly from one end of the beam 33*a* for engaging with the latching wedges 13 of the first connector 10. The slim beam 33*a* and the shoulder 33*c* have an identical thickness, which is substantially identical to the thickness of each latching wedge 13 of the first connector 10. Rear ends 33*b* of the outer latches 33 are further bridged by a handle 34. When the handle 34 is pulled upward, the shoulders 33*c* of the outer latches 33 are pivoted away from each other. The base bar 31 further includes a pair of horns 35 for limiting inward movement of the rear ends 33*b* when the handle 34 is pulled upward. Once the handle 34 has returned to its original position, engagement between the shoulders 33*c* and the latching wedges 13 is ensured. In addition, the clipping force provided by the outer latches 33 is further enhanced by the handle 34.

Figure 4:
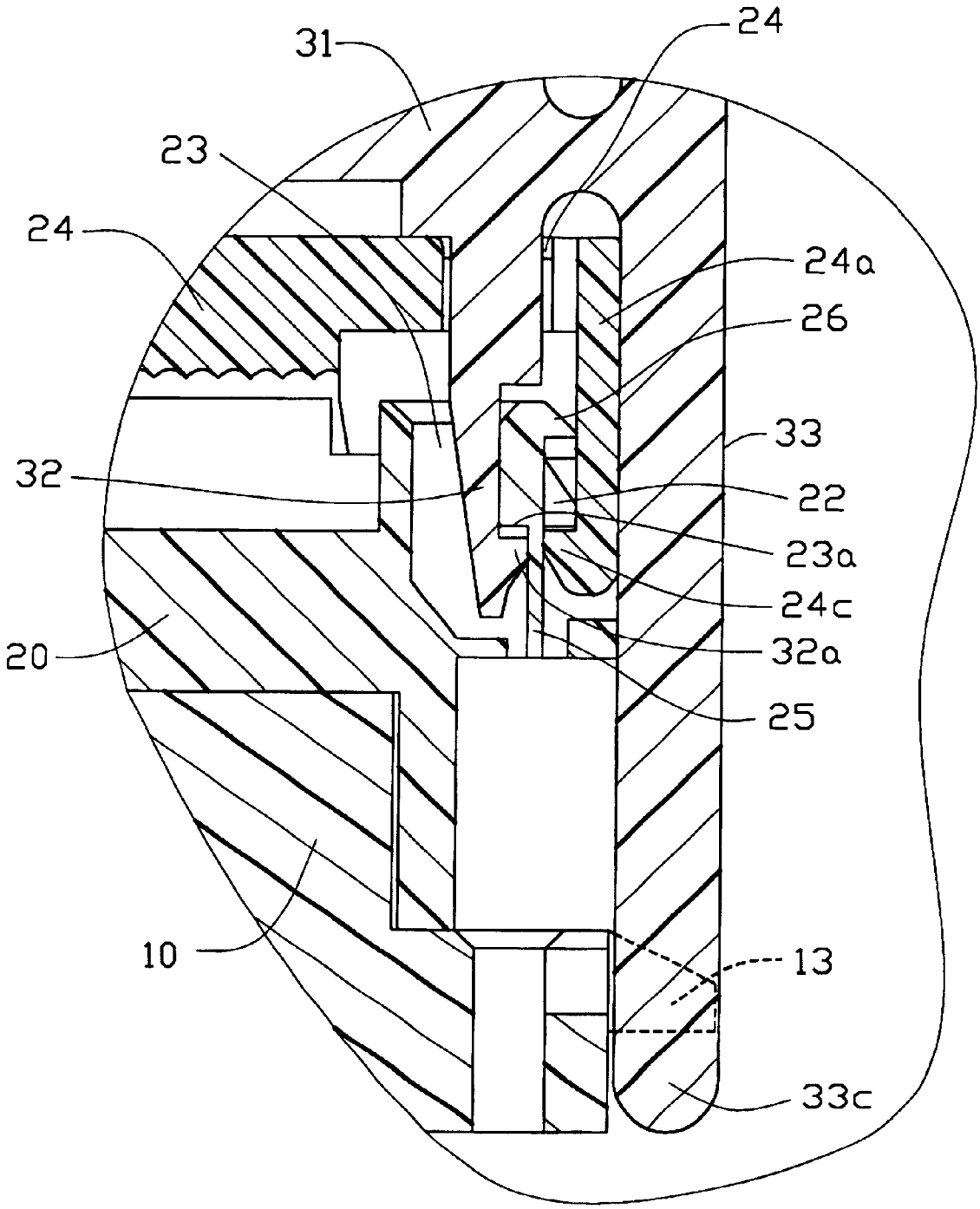
FIG. 4 is a partial cross sectional view showing relationship of the components of the electrical assembly of the present invention.

As is clearly shown in FIG. 4, the inner latch 32 is well protected within the retaining recess 23 such that engagement between the projection 32*a* and the engaging block 23*a* can never be accidentally released by the latching wedges 13 when the second connector 20 is assembled to the first connector 10.

Figure 3:
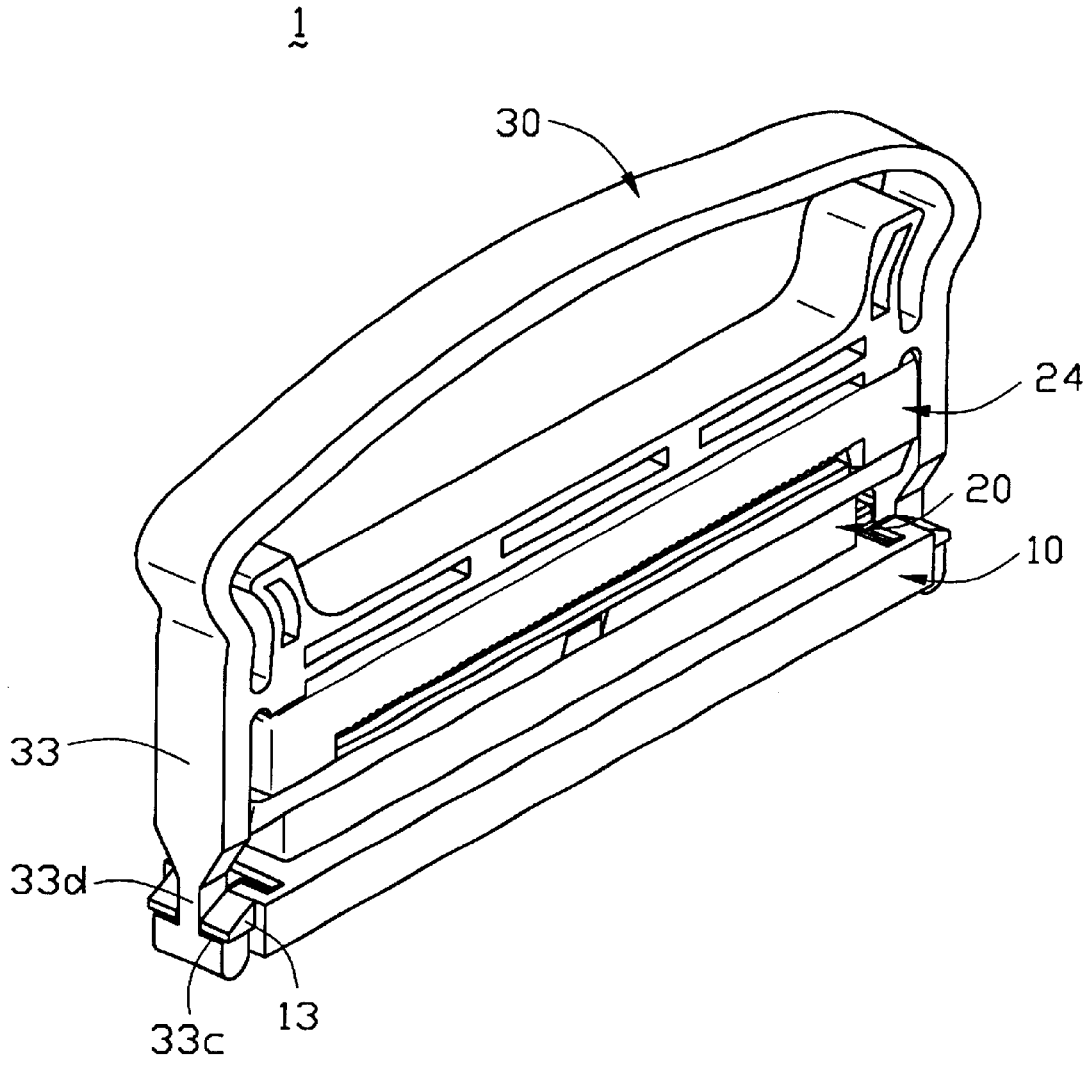
FIG. 3 is an assembled view of FIG. 1.

In assembly, referring to FIGS. 3 and 4, the termination cover 24 firstly rests on the support wedges 26 of the second connector 20 for leaving an enough wide gap for insertion of the FFC connector. Then the cover 24 is further depressed and the inward projections 24*c* thereof are engaged with the mounting wedges 22 to make termination between the IDC connector and the FFC connector. The strain relief 30 is then assembled to the second connector 20 by the engagement between the inner latches 32 and the retaining recesses 23. Then the second connector 20 can be assembled to the first connector 10. The shoulders 33*c* of each outer latch 33 are abuttedly engaged with the latching wedges 13 and the slim beam 33*a* is sandwiched between the latching wedges 13. In addition to the mating between the cavity and the island portion 12, the mating is further enhanced by the engagement between the outer latches 33 and latching wedges 13.

When unmating between the second connector 20 and the first connector 10 is desired, the handle 34 is pulled upward whereby the rear ends 33*b* are moved toward each other, thereby causing the shoulders 33*c* of the outer latches 33 to move to a position further apart, thereby releasing the shoulders 33*c* from the latching wedges 13. In addition, the upward pulling force may easily separate the second connector 20 from the first connector 10.

It is noted that the mounting lug 24*a* of the cover 24 and the inner latch 32 of the strain relief 30 latchably engage, respectively, with the corresponding mounting wedge 22 and the engaging block 23*a*, which are located on opposite sides of the end wall 25 (FIG. 4) of the second connector 20. This arrangement allows the strain relief 30 and the cover 24 to reliably lock with the second connector 20 without their latching mechanisms interfering with each other. Furthermore, the mounting lug 24*a* of the cover 24 is further sandwiched between the outer latch 33 of the strain relief 30 and the end wall 25 of the second connector 20, thus assuring engagement between the terminal cover 24 and the second connector 20. It is also noted that, since the slim beam 33*a* has a thickness identical to that of the latching wedge 13, an outer surface 33*d* (see FIG. 3) of the outer latch 30 is generally flush with the latching wedge 13, thereby ensuring the overall length of the electrical connector assembly 1 is shortened in comparison with the type disclosed in the parent application which use's the inward projection rather than the slim beam 33*a* and the associated shoulders 33*c* of the invention, thus resulting in a longer dimension along the lengthwise direction of the whole assembly. From another viewpoint, because the lengthwise dimension of the strain relief 30 can be minimized, the outer latch 33 may abut against the mounting lug 24*a* of the cover 24 without the gap therebetween for better protection as performed in the parent application.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector assembly, comprising:

a first connector adapted for being assembled to a printed circuit board, said first connector including a first housing having a base plate and an island portion on the base plate, a pair of spaced latching wedges formed on opposite ends of said base plate;

a second connector mated to said first connector, said second connector including a second housing defining a cavity for receiving said island portion of said first connector and a termination face opposite to said cavity, a pair of mounting wedges formed on opposite ends thereof, said second housing further defining a pair of retaining recesses adjacent to said mounting wedges, a termination cover assembled to said termination face of said second housing, said cover including a pair of mounting lugs engageable to said mounting wedges, and a pair of passages defined in said cover adjacent to said mounting lugs; and a strain relief assembled to said second connector, said strain relief forming a base bar, inner latches extending through the passages of said cover to be fixedly engaged in said retaining recesses, and outer latches pivotally hinged to said base bar, said outer latches each forming a slim beam for releasably interlocking with a corresponding pair of latching wedges, and a pair of shoulders perpendicularly extending from the slim beam for engaging with said latching wedges of the first connector when said second connector is mated to said first connector;

wherein each shoulder of the outer latch of the strain relief and the latching wedge of the first connector have a substantially identical thickness;

wherein the pair of latching wedges extend outwardly from each end of the base plate of the first connector;

wherein said retaining recesses each further include a block on an inner wall thereof for engaging with a projection formed on a tip of a corresponding inner latch;

wherein said passages of said cover are each aligned with a corresponding retaining recess of said second housing;

wherein said base bar further includes a pair of horns on ends thereof for limiting pivotal movement of said outer latches;

wherein rear ends of said outer latches are bridged by a handle.

* * * * *